US007992747B2

(12) United States Patent
Bauer

(10) Patent No.: US 7,992,747 B2
(45) Date of Patent: Aug. 9, 2011

(54) PRODUCT DISPENSER ASSEMBLY AND CARTRIDGE FOR HOLDING PRODUCT

(76) Inventor: Jamie Bauer, Edgewater, NJ (US)

( * ) Notice: Subject to any disclaimer, the term of this patent is extended or adjusted under 35 U.S.C. 154(b) by 374 days.

(21) Appl. No.: 12/391,797

(22) Filed: Feb. 24, 2009

(65) Prior Publication Data

US 2009/0212066 A1 Aug. 27, 2009

Related U.S. Application Data

(60) Provisional application No. 61/031,090, filed on Feb. 25, 2008.

(51) Int. Cl.
*B65H 1/00* (2006.01)

(52) U.S. Cl. ..... 221/197; 221/191; 221/198; 206/817; 211/59.2; 211/74

(58) Field of Classification Search ..... 221/197, 221/198, 175, 191; 206/817; 211/59.2, 59.3, 211/74

See application file for complete search history.

(56) References Cited

U.S. PATENT DOCUMENTS

| | | | | |
|---|---|---|---|---|
| 902,347 | A | 10/1908 | Tillinghast | |
| 1,898,056 | A | 2/1933 | Johnson | |
| 2,996,344 | A | 8/1961 | Garman | |
| 3,055,293 | A | 9/1962 | Lariccia | |
| 3,178,242 | A | 4/1965 | Ellis et al. | |
| 3,203,554 | A | 8/1965 | Pendergrast, Jr. et al. | |
| 3,300,115 | A | 1/1967 | Schauer | |
| 3,923,159 | A | 12/1975 | Taylor et al. | |
| 4,435,026 | A | 3/1984 | Johnson | |
| 4,598,828 | A | 7/1986 | Young et al. | |
| 4,823,982 | A * | 4/1989 | Aten et al. | 221/3 |
| 4,915,571 | A | 4/1990 | Toshihiko et al. | |
| 5,289,943 | A | 3/1994 | Powell | |
| 5,314,078 | A | 5/1994 | Morikiyo et al. | |
| 5,328,258 | A | 7/1994 | Scalise | |
| 5,390,821 | A * | 2/1995 | Markel | 221/194 |

(Continued)

FOREIGN PATENT DOCUMENTS

JP 07-124041 A 5/1995

(Continued)

OTHER PUBLICATIONS

International Search Report and Written Opinion for International Application No: PCT/US2009/055082. Issued on May 18, 2010.

*Primary Examiner* — Patrick Mackey
(74) *Attorney, Agent, or Firm* — Brown & Michaels, PC

(57) ABSTRACT

A product holding, displaying and dispensing assembly includes a dispenser housing having a feed channel and a dispensing location together with a pre-packed, shipping cartridge holding a plurality of product units. The cartridge is inserted and held within the dispenser housing as the product units move within the cartridge to the dispensing location where a consumer can access and remove one or more product units. Unlike more conventional dispensers, the assembly of the present invention is configured so that the pre-packed cartridge is loaded into and remains within the housing as the product units are dispensed and advance forward within the dispenser. After insertion, the cartridge is locked in place by an arrangement of the feed track when one or more cans remain in the cartridge, but can be removed easily when the cartridge is empty. A forward facing surface also provides an additional advertising medium.

15 Claims, 11 Drawing Sheets

U.S. PATENT DOCUMENTS

| | | | | |
|---|---|---|---|---|
| D363,174 | S | | 10/1995 | Fletcher |
| 5,462,198 | A | | 10/1995 | Schwimmer |
| 5,788,117 | A | * | 8/1998 | Zimmanck ..... 221/285 |
| 5,836,478 | A | | 11/1998 | Weiss |
| 5,878,862 | A | | 3/1999 | Dewsnap |
| 5,894,942 | A | | 4/1999 | Miyashita et al. |
| 6,253,930 | B1 | | 7/2001 | Freidus et al. |
| 6,991,116 | B2 | | 1/2006 | Johnson et al. |
| 2007/0007221 | A1 | | 1/2007 | Mann |
| 2010/0072150 | A1 | | 5/2010 | Takashima et al. |

FOREIGN PATENT DOCUMENTS

| | | | |
|---|---|---|---|
| JP | 11-346880 | A | 12/1999 |
| JP | 2008-080058 | A | 4/2008 |

* cited by examiner

PRODUCT DISPENSER ASSEMBLY AND CARTRIDGE FOR HOLDING PRODUCT

REFERENCE TO RELATED APPLICATIONS

This application claims one or more inventions which were disclosed in Provisional Application No. 61/031,090, filed Feb. 25, 2008, entitled "PRODUCT DISPENSER AND CARTRIDGE FOR HOLDING PRODUCT". The benefit under 35 USC §119(e) of the United States provisional application is hereby claimed, and the aforementioned application is hereby incorporated herein by reference.

BACKGROUND OF THE INVENTION

1. Field of the Invention

The present invention relates to the field of retail packaging and displays and, more particularly, to a retail product dispenser that receives a cartridge that holds product packages and further includes a feed mechanism to cause the product in the cartridge to be delivered to a consumer, while the cartridge remains at the dispenser location.

2. Description of Related Art

There are a number of types of product displays; however, one of the basic product displays consists of traditional shelves on which individual products are placed. This arrangement is found in most retail stores, including clothing stores and in particular, in grocery stores. Typically, the products are arranged and loaded for bulk shipment into SKU cartons that are currently sized, designed and packed considering only operational and pallet size parameters and using package counts (usually based on dozens in English countries).

For display and sale at a retail store, the individual product packages are then unpacked and removed from the SKU carton and placed either on the shelves or into any of a variety of conventional displays. This is a very time consuming and labor intensive task during which a store stocker cuts open the SKU carton and individually places the products. The product is arranged in rows, etc. and may be stacked on top of one another. The stocker then must discard the empty SKU carton and other packaging material as waste.

Another associated disadvantage of this arrangement is that the stocker must continuously check and rotate the stock so that it remains fresh. This requires continuously pulling the older stock forward and adding the newer stock behind it. This is a time consuming task and if delayed, the shelves develop an unkempt appearance. Further, if this stock rotation process is neglected, older stock may remain at the rear of the shelf, possibly past its expiration. A variety of displays which enable automatic stock rotation are known to the art, but all must be loaded with individual product packages, as previously described.

One at a time dispensing packages have been known to the art. Such packages usually comprise a vertical carton for housing a number of objects such as batteries or cans or other cylindrical objects, where a slot is perforated or cut in one side. For example, see U.S. Pat. No. 902,347 "Vending Carton or Package"; U.S. Pat. No. 1,898,056 "Dispensing Carton"; U.S. Pat. No. 3,300,115 "Compartmented Dispensing Carton Formed from a Single Blank"; or U.S. Pat. No. 5,836,478 "Battery Dispenser". There have also been some horizontal dispensing cartons, such as U.S. Pat. No. 3,178,242 "One Piece Dispensing Carton for Cylindrical Objects". While such designs are called "dispensers", they do not actually dispense, but rather allow the products to feed by gravity toward an opening where an arrangement of walls in combination with said opening prevents them from issuing forth on their own, rather enabling a person to manually remove the items in a one-at-a-time manner. In essence they present the products for selection, but otherwise impede their issuance therefrom.

Some such cartons were designed for point-of-sale displays, such as U.S. Pat. No. 2,996,344 "Dispensing Carton" or U.S. Pat. No. 3,203,554 "Can Carton Rack". In such cases, the dispensing carton sits on a conventional shelf or an inclined wire rack of general applicability, and when a carton is empty another carton of another kind can be substituted, which is not desirable from the point of view of the product manufacturer, who would like to retain the shelf space for its own products as proprietary retail space.

Serpentine racks for use with cans or other cylindrical packages are in common use in stores, where the cans are retained by rails or shelves on a back-and-forth path. For example, see U.S. Pat. No. 4,915,571 "Device for Loading Cans, Bottles or the like into a Dispensing Mechanism", or U.S. Pat. No. 6,991,116 "Multi-Chute Gravity Feed Dispenser Display". Serpentine racks are most often fed manually one can at a time, although these two patents show the use of cartons or a specially designed device for dump type feeding the cans into the upper end of the serpentine.

While this intends to reduce stocking time and labor, it has the following drawbacks: When relatively heavy canned product packages, such as soup or canned vegetables and the like, are loaded one-at-a-time into typical roll-down, serpentine systems such as the patents above illustrate (especially when they are dump loaded), the cans pick up speed as they roll downward through the channels. At each transition, especially where vertical drops are involved, said cans literally "hammer" against the floor and wall surfaces of the display housing. This causes a significant durability problem for such devices, especially when they are fabricated of plastics, as they often are. The raucous noise it creates is also disconcerting to nearby shoppers and presents a negative shopping experience.

U.S. Pat. No. 3,055,293 "Storage and Dispensing Rack for Cans and the Like" and U.S. Pat. No. 3,923,159 "Product Display and Article Dispensing Device" combine vertical dispensing packages of cans from pre-existing conventional cartons with a gravity feeding rack or roll down serpentine tracks. These present the following disadvantages. The cartons are, like the prior art cited above, conventional boxes with slots cut or perforated on one end, the intent of which is to enable the cans to automatically issue forth from the carton and into the dispensing portions of the racks. Such packages are not specifically designed for the reliability of such can flow and have a tendency to mis-feed when two cans jam in the exit slot. This is especially true when the opening is not pre-designed, but hand cut by the stocking person. Both are constructed without regard for standard shelving already in place at retail stores and the efficient use thereof. They either require retailers to invest in extensive additional specialized racks to provide a gravity feed apparatus and/or are intended as a display only and make no efficient use of retail space and other potential synergies.

U.S. Pat. No. 4,598,828 "Storage and Dispensing Rack" is representative of systems where products sit on inclined shelves and, theoretically, self-feed to the front of the shelf by sliding down the incline. As a practical matter, friction presents a major problem in such systems, and is particularly a problem when the products are retained in cardboard trays which have a comparatively rough surface. That condition is further aggravated during shipment when the products are hammered into the tray floor causing indents which act to further hold the products in their respective positions in the tray.

SUMMARY OF THE INVENTION

A product holding, displaying and dispensing assembly includes a housing having a feed channel and a dispensing location together with a pre-packed, shipping cartridge holding a plurality of product units. The cartridge is inserted and held within the dispenser housing as the product units move within the cartridge to the dispensing location where a consumer can access and remove one or more product units. Unlike more conventional dispensers, the assembly of the present invention is configured so that the pre-packed cartridge is loaded into and remains within the housing as the product units are dispensed and advance forward within the dispenser. After insertion, the cartridge is locked in place by an arrangement of the feed track when one or more cans remain in the cartridge, but can be removed easily when the cartridge is empty. This reduces stocking complexity and the time involved in the stocking process. A pre-printed or labeled forward facing surface also provides an additional advertising medium, which, because it was applied at the point of manufacture, is dedicated to the specific products dispensed therefrom and cannot be mistakenly applied to other products.

DETAILED DESCRIPTION OF THE INVENTION

The present invention relates to a system of combined "cartridge" carton designs and "cartridge" carton accepting display devices which, when integrated together into packaged goods packing operations, logistics and supply chain management and retail operations and handling, reduces handling costs and increases efficiencies and sales effectiveness for packaged consumer goods sold at retail stores. Individual package handling at retail, currently required to stock inventory of products on shelves for display and sale to shoppers, will be reduced, thus significantly reducing handling time, labor and the associated costs in the supply chain and at retail. Time stamped, date coded products, which have freshness and expiration issues, are automatically stocked and sold according to first in, first out principles without additional handling. This allows displays to be restocked before they are empty, minimizing out-of-stock situations (an extreme deterrent to sales).

The resulting availability and organizational management of products sold in the system at retail improves the shopping experience for shoppers by effectively reducing the time spent shopping, especially time wasted looking for particular brands, SKUs and types/flavors of goods. This benefit is expected to result in increased sales of goods displayed and sold within the system.

By installing the display vehicles permanently in stores and by manufacturing the cartons of the invention from 100% recycled and recyclable materials, sustainability issues are addressed in a significant manner according to current requirements of green advocacy. Certain portions of the permanent display vehicles will also be manufactured from a percentage of recycled and recyclable materials adding to that benefit.

Figure 1:
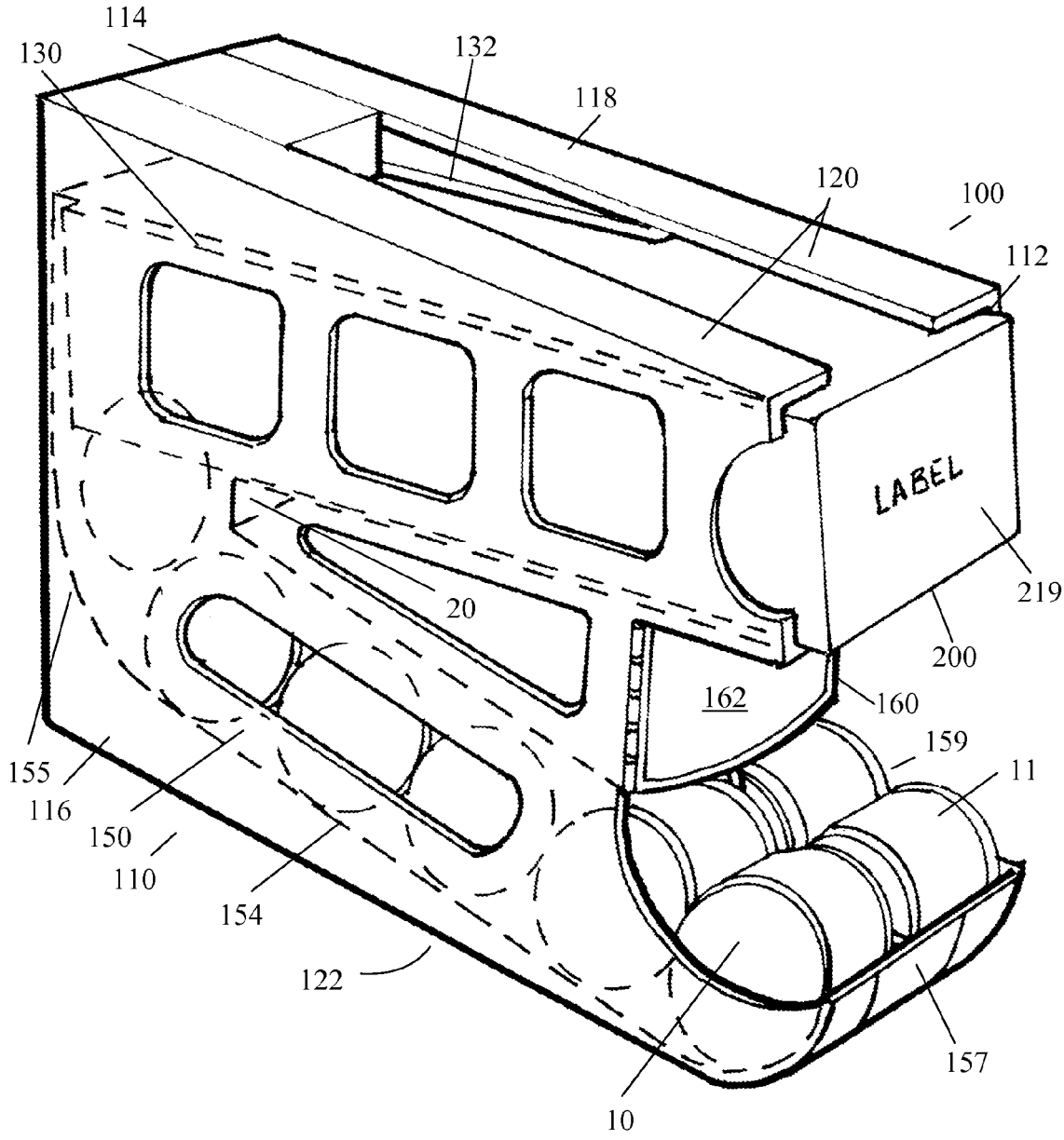
FIG. 1 is a perspective view of the product dispenser of the invention.
Figure 2:
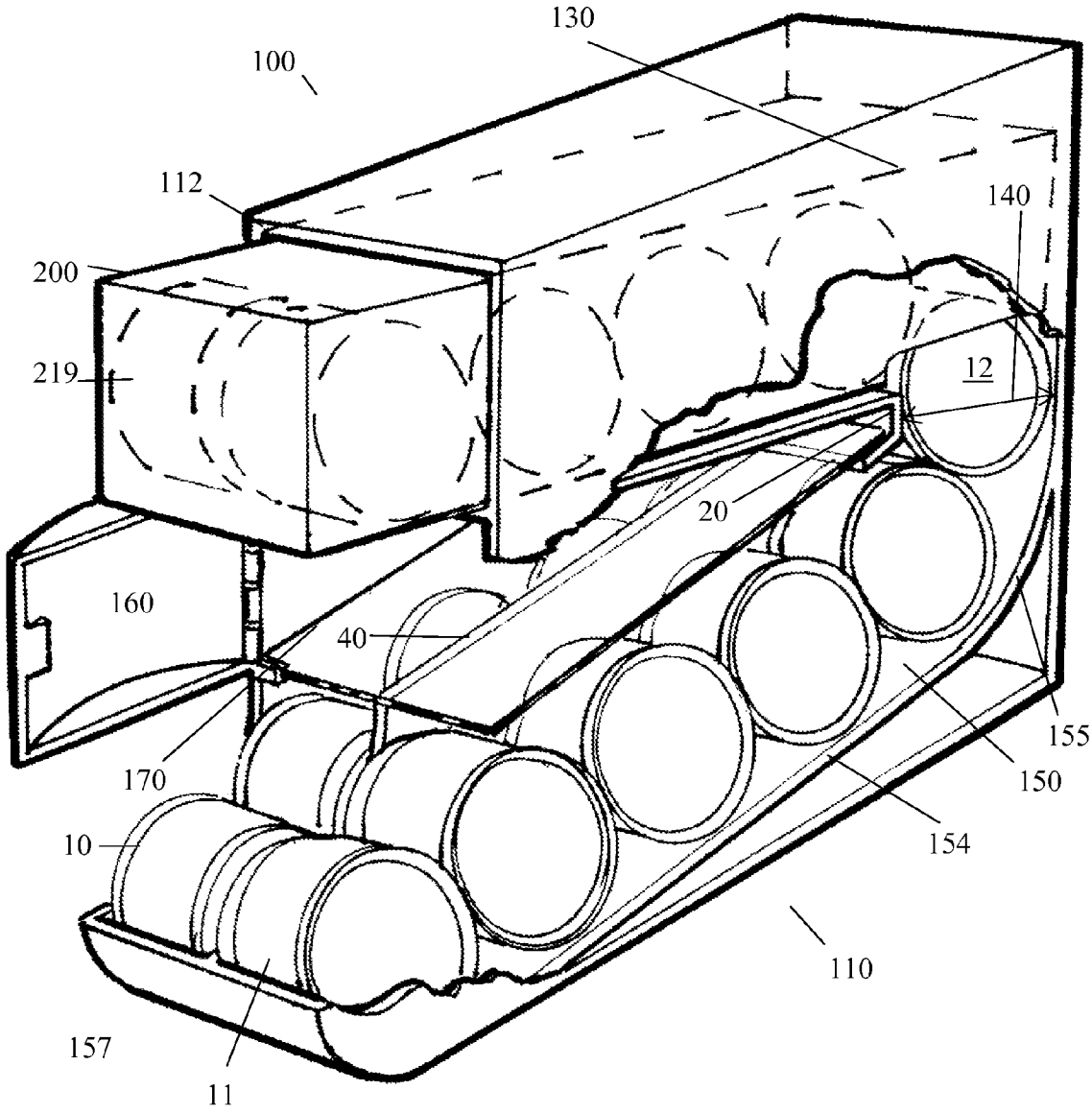
FIG. 2 is a perspective view, partially broken away, of the product dispenser.
Figure 11:
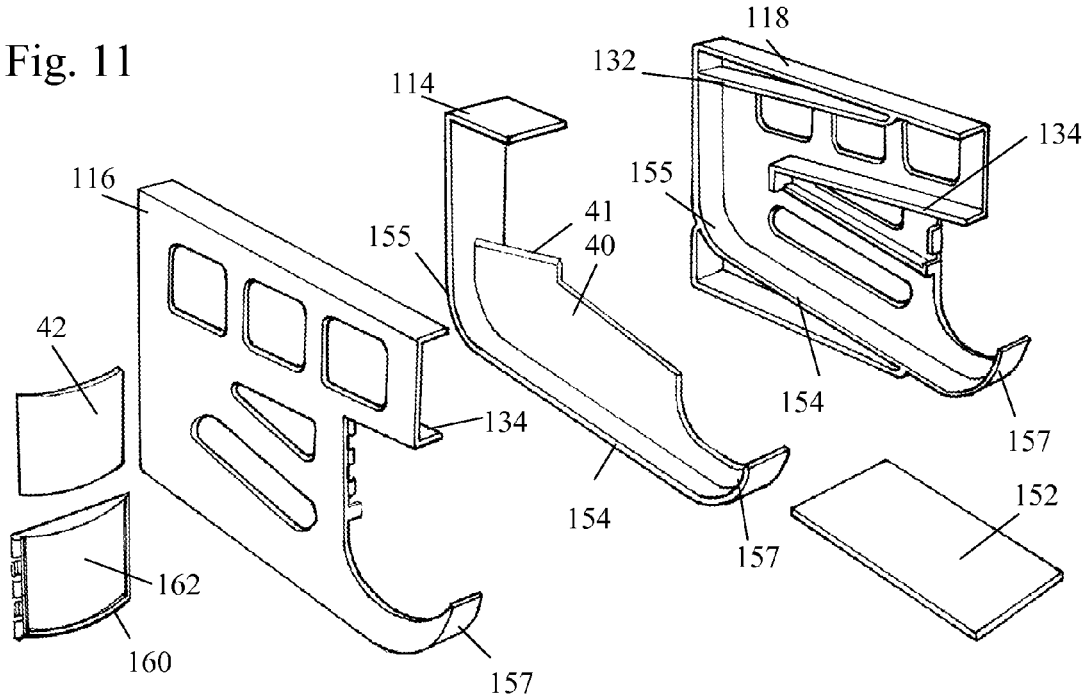
FIG. 11 is a perspective, exploded view of the product dispenser

FIGS. 1 and 2 show a product dispenser 100 of the invention. FIG. 11 shows an exploded view of one way of making the dispenser of FIG. 1.

The dispenser 100 is formed of a housing 110 that includes a front 112, a rear 114 and two sides 116, 118, as well as a top 120 and a bottom 122. The housing 110 is a substantially hollow member in that it includes an interior compartment that receives, holds and dispenses the product as described below. The top 120, bottom 122, and rear 114 are closed off by walls; however, the front 112 is partially open to both allow a shopper to access the product and to allow a stock clerk to view products and load product cartridges.

It will be appreciated, as discussed below and illustrated in the figures, the term "cartridge" relates to a carton design (e.g., cartridge carton, tray or package) and is to be broadly interpreted as a structure that holds product units as opposed to being merely limited to a unitary structure, such as an injection molded, metal or other permanent manufactured item. In other words, the cartridge can be thought of as any carton specifically designed to function within display dispensers of the present invention. As described below, the cartridge can be formed of a paper material, etc.

Within the housing 110, a first channel 130 is formed and, in the design shown in FIGS. 1 and 11 defined by the ribs creating the first ceiling 132, and an opposite floor 134, and the two sides 116, 118 of the housing 110. The first channel 130 is open at the front 112 of the housing 110 and is closed at the rear 114 of the housing 110.

The first channel 130 is a cartridge loading channel in that it is sized for receiving a cartridge 200 that contains the product as shipped, and that is dispensed to the consumer. The shape of the first channel 130 is thus complementary to the shape of the cartridge 200 and thus, in the illustrated embodiment, the first channel 130 and cartridge 200 each has a rectangular or square cross-sectional shape; however, other shapes are possible.

The first channel 130 is formed at an angle within the housing 110 so that when the cartridge 200 is inserted, the cartridge 200 is held at an angle. For example, an angle between the ceiling 132 and the horizontal top edges of the side panels 116, 118 of the housing 110 can be approximately 7 degrees. Other angles can be used so long as the angle is sufficient to cause the product that is inserted within the first channel 130 to move under gravitational forces from the front 112 toward the rear 114 of the housing 110.

The floor 134 of the first channel 130 terminates prior to the rear 114 of the housing 110 so as to create and form an opening 140 that provides communication between the first channel 130 and an underlying second channel 150.

The second channel 150 has a shape that is similar to the first channel 130 and is formed and defined by a first ceiling 152, an opposite floor 154, and the two sides 116, 118 of the housing 110. The second channel 150 is open at the front 112 of the housing 110 and is closed at the rear 114 of the housing 110.

Similar to the first channel 130, the second channel 150 is angled within the housing 110 to allow product to move therealong under gravitational force. The floor 154 of the second channel 150 is angled at approximately 7 degrees relative to the horizontal bottom edges 122 of the housing 110.

Figure 6A:
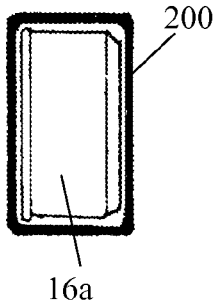
FIGS. 6*a* and 6*b* are front elevation views of a cartridge and of the product dispenser in a single-can wide embodiment.
Figure 7A:
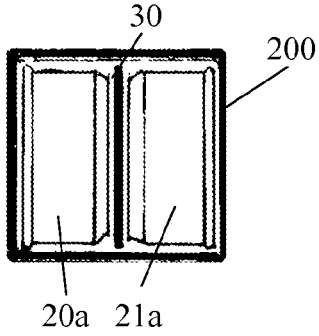
FIGS. 7*a* and 7*b* are front elevation views of a cartridge and of the product dispenser in a two-can wide embodiment.
Figure 8A:
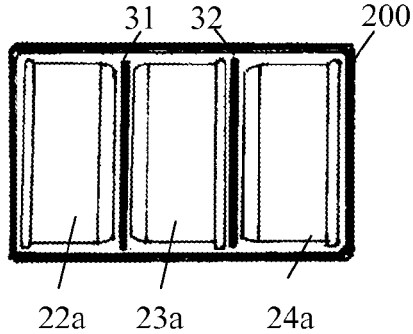
FIGS. 8*a* and 8*b* are front elevation views of a cartridge and of the product dispenser in a three-can wide embodiment.
Figure 6B:
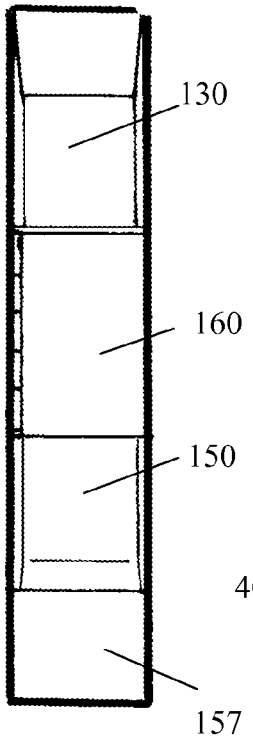
Figure 7B:
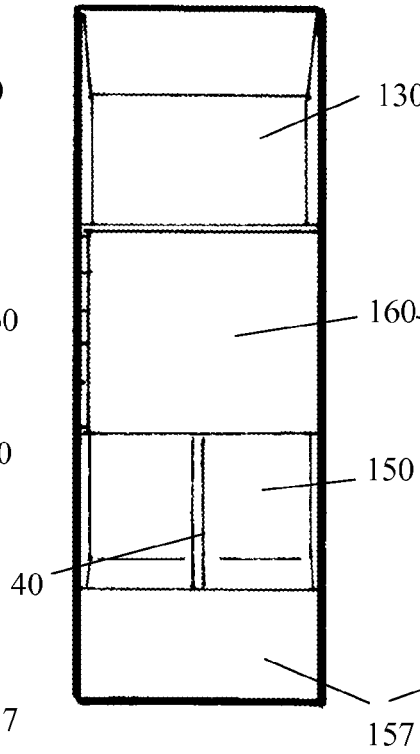
Figure 8B:
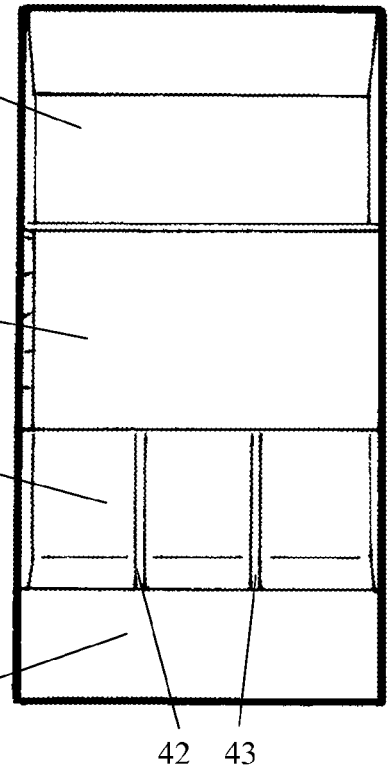

As shown in FIGS. 1, 2, 7*b*, 10*a*-10*b* and 11, when the dispenser is set up for two-wide dispensing of two parallel lines of products, a divider wall 40 is provided within channel 150 to guide and separate the products into two respective side-by-side sections of the channel 150 as it is transferred from cartridge 200 and channel 130 and is delivered to the consumer. In a single wide variation of the dispenser, as shown in FIG. 6*b*, this divider wall is not present and in a three (or more) facing variation of the dispenser as shown in FIG. 8*b*, there are two (or more) such divider walls 42 and 43.

The size of the opening 140 is selected in view of the size of the individual product contained in the cartridge 200 so that the product can be transferred from the channel 130 to the channel 150 by passing through the opening 140. The orientations of the two channels 130, 150 and the presence of the opening 140 causes the product within the dispenser 100 to move (drop and roll) in a serpentine pattern from the first channel 130 to the second channel 150 where the products are delivered to the consumer. On the inside of, and forwardly disposed to, opening 140, there is a vertical blocking section 20, the purpose of which will be explained below.

In addition, the floor 154 of the second channel 150 connects to opening 140 with a sloped portion 155, preferably a curved ramp, near the rear 114 of the housing 110 to assist in the smooth transition of the product from the first channel 130 to the second channel 150, thereby reducing any "hammering" effect of dropping product units onto floor 154 of the dispenser. As illustrated, the length of the second channel 150 can be greater than the length of the first channel 130 to permit the second channel 150 to receive and store more product than the first channel 130 since it is the second channel 150 from which the product is dispensed forward to the consumer. The front of the second channel 150 thus extends beyond the front of the first channel 130. Similar to the rear thereof, the front of the second channel 150 includes a sloped surface 157 that acts as a stop for the product and positions and displays the product to the consumer to permit the consumer to retrieve the product through an opening 159 formed in the housing 110.

The housing 110 also includes a door 160 that is formed along the front thereof between the first and second channels 130, 150. The door 160 opens into a space 170 that is formed between the floor 134 of the first channel 130 and the ceiling 152 of the second channel 150. The door 160 can utilize any number of different types of door assemblies and in the illustrated embodiment, the door 160 is in the form of a hinged door 160 that pivots open. The space 170 has a roughly triangular shape, with the tip of the triangle squared off by blocking section 20.

It will be appreciated that an outer surface of the door 160 includes a surface 162 for displaying indicia, such as advertising, promotional information, product information, etc. In some embodiments of the present invention, products are dispensed to shoppers on their sides. In these cases, the door surface 162 can be formed and labeled to replicate in appearance the dispensed product in its upright orientation, thereby providing a clear illustration for shoppers to more quickly and easily read, locate and properly select the product.

In addition, the ceiling 152 of the second channel 150 is preferably formed of a transparent material to permit easy viewing of the product within the second channel 150. This is especially helpful to determine the inventory counts of product units currently held within channel 150. For example, a person charged with counting or stocking product in the dispenser 100 simply opens the door 160 and is able to see through the transparent ceiling 152 to make a product count or determine if the dispenser needs restocking. The door 160 is then closed. The door 160 can be hinged with a spring loaded or similar self-closing device or mechanism, which will eliminate the possibility that a stocker may inadvertently leave it open.

The first channel 130 is formed at an angle within the housing 110 so that when the cartridge 200 is inserted, the cartridge 200 is likewise held at an angle. Unlike other, more conventional product display units where the products are removed from the packaging and then manually inserted into a dispenser, either individually or by dumping from a carton, the dispenser 100 is specifically configured so that the product is loaded into the dispenser 100 by inserting the prepacked cartridge 200 into the dispenser. The cartridge 200 is simply left in the dispenser until it becomes empty.

The cartridge 200 should be at least the length of channel 130, as shown in FIG. 1—preferably it will be longer, so as to protrude forward from the display's upper channel 130, as shown in FIG. 2—or it will not be easily removable by stockers. Arcuate cut-outs can be formed in the sides of channel 130, as shown in FIG. 1, to provide finger grip space for cartridges which are approximately the same length as the channel 130.

FIGS. 4, 5, 6*a*, 7*a*, 8*a*, and 9 illustrate cartridge 200.

Figure 4:
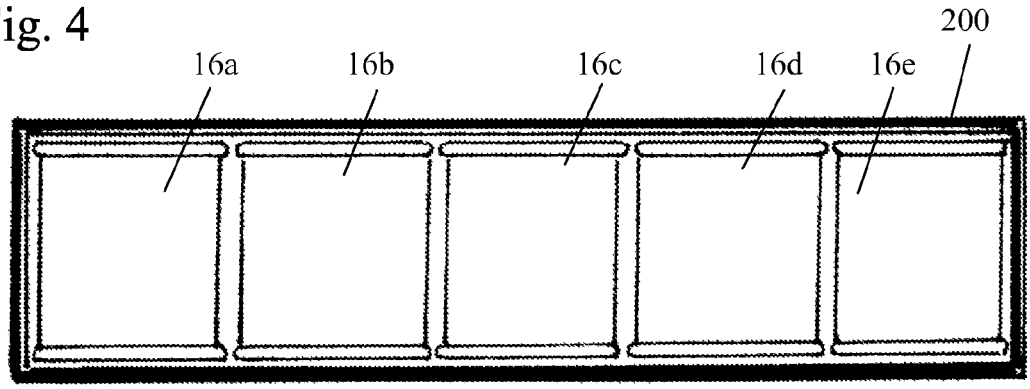
FIG. 4 is a top view of a two-can wide product cartridge for use with the product dispenser.
Figure 5:
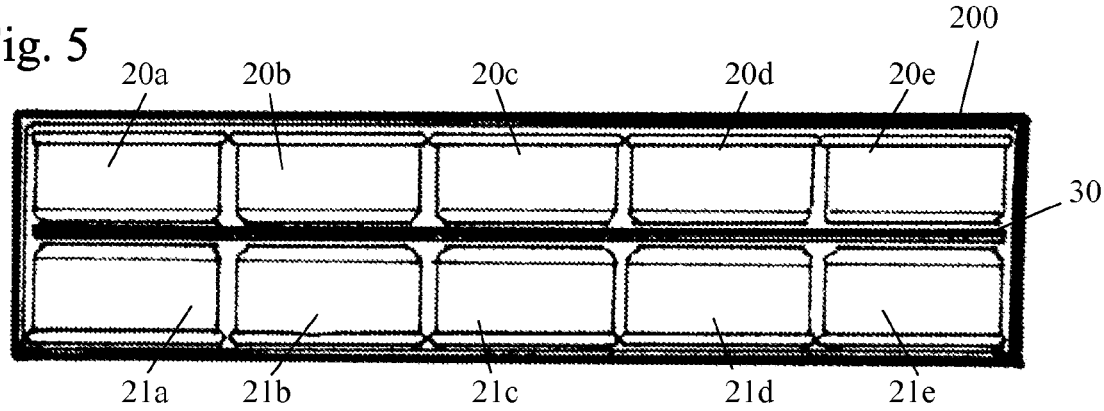
FIG. 5 is a top view of a one-can wide product cartridge for use with the product dispenser.
Figure 9:
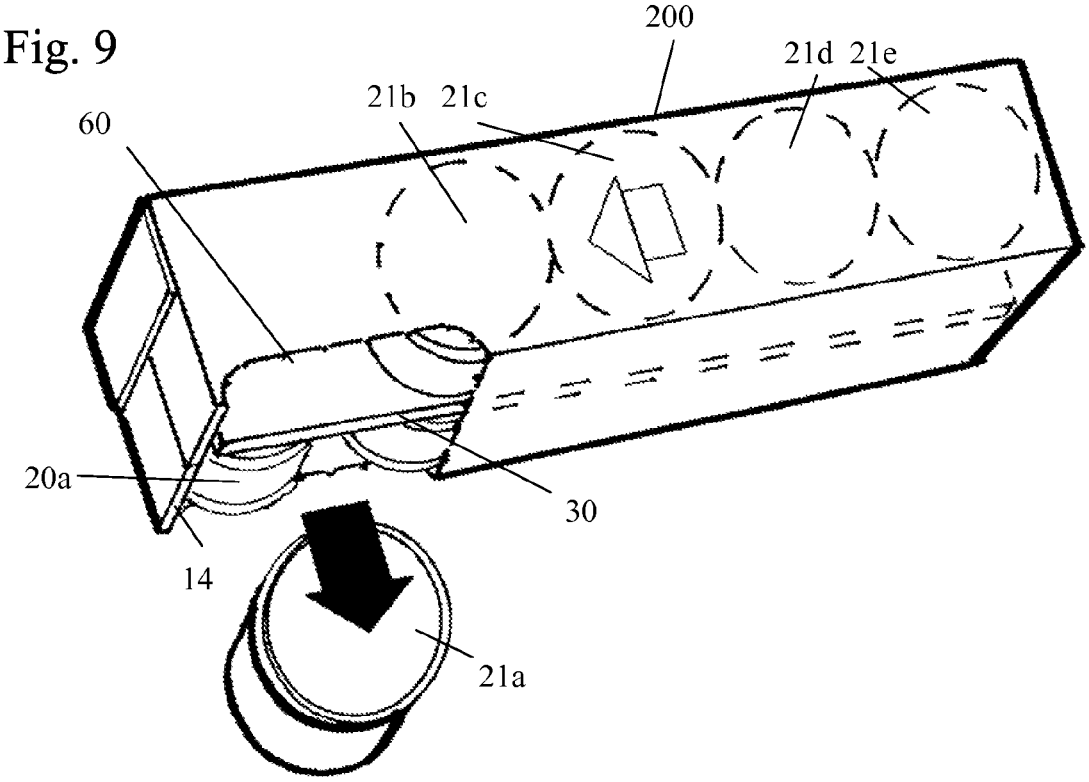
FIG. 9 is a perspective view from underneath of a cartridge for use in the product dispenser, showing a can leaving the cartridge.

In the embodiment shown in FIGS. 5, 7*a* and 9, the cartridge 200 is a two-wide facing type cartridge, in that two rows of product are packed side-by-side. In FIGS. 5 and 9, these are shown as cans 20*a*-20*e* and 21*a*-21*e*. FIGS. 4 and 6*a* show a one-wide cartridge, the cans being shown as 16*a*-16*e* in FIG. 4. FIG. 8*a* shows a three-wide cartridge.

This type of orientation permits the product to easily and reliably roll within and issue from both the cartridge 200 and the dispenser 100. In the two- or three-wide embodiments, a separator partition 30, 31, 32 separates the products into individual interior rows of product, thereby guiding the products and preventing the rows from shifting or binding up against each other.

The cartridge 200 is typically formed of a paper product, such as cardboard, however, it can be formed of other materials, such as plastics, so long as the cartridge 200 includes an openable section 60, which is sized so that the product can easily exit therethrough. The openable section 60 represents a portion of the cartridge 200 that can be easily removed by the stocker when insertion of the cartridge 200 into the dispenser 100 is desired, preferably by hand without the need for a knife. The openable section 60 can be a perforated section of the cartridge that can be separated from the rest of the cartridge, could be an opening covered by a removable label or tape, or could be formed in any other convenient fashion.

To minimize the jamming problem evident in prior art dispensing packages, the cartridges 200 used with the present invention are only one can diameter in height, but may be one or more cans in at use width, as illustrated and discussed above. This may be seen as a limitation, but is actually a plus. This is because retail gondola fixtures measure approximately 24" deep (which is as far as a reasonable design can expect a shopper to be able to successfully reach and is often too deep for many shoppers, hence the desire to design display systems which automatically front feed or front face the products therein). The approximately 6 foot height of retail gondolas is a severe restriction. If the 6 feet of useful gondola height is not used efficiently, the products must be spread outwardly left-to-right, thereby decreasing the entire store's useful gondola space for other products. By limiting the cartridges to an in use height of one can diameter, the dispenser of the invention forces brands and retailers alike to use the gondola height more efficiently than if the display system was designed to accept any bulk pack case currently available.

Figure 3:
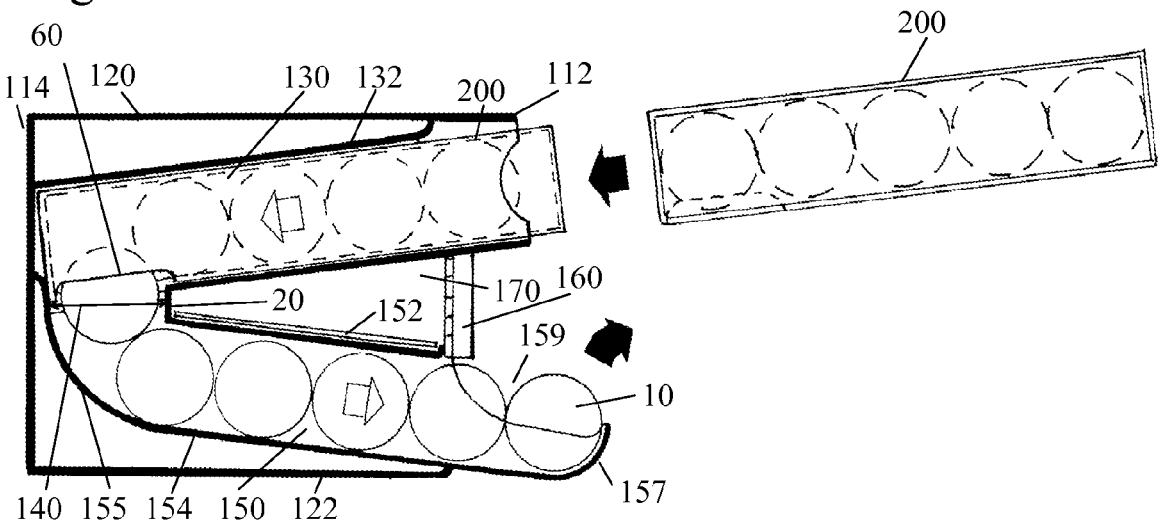
FIG. 3 is a side elevation view of the product dispenser and a cartridge with a side wall of the dispenser being removed to illustrate the internal construction of the dispenser.

FIG. 3 shows a cartridge being inserted into channel 130. To load the dispenser 100, the openable section 60 is opened by removing this section, removing the label or tape, or whatever means is appropriate. The stocker then places his or her hand over the feed opening 60 to contain the products in the cartridge 200 while the cartridge 200 is inverted and loaded into the first channel 130 by first inserting the partially opened end of the cartridge 200. The partially opened bottom thus faces the floor 134 of the first channel 130 which further prevents product units from exiting the cartridge during installation into channel 130. The cartridge 200 is then moved along the floor 134 until it is fully loaded into the first channel 130 which will be evidenced by the front end of the cartridge abutting against the rear 114 of the housing 110. In this position, the feed opening 60 overlies the opening 140. Product then can leave opening 60 and roll down surface 155 into channel 150.

It will be appreciated that the angled nature of the first channel 130 and the presence of the feed opening 60 causes product to roll out of the cartridge 200 through the feed opening 60 and then by gravity, the product falls into the second channel 150. The sloped nature of the second channel 150 likewise causes the product to roll from the rear 114 to the front of the housing 110 where the product 10, 11 abuts against and is stopped by the sloped surface 157. As product is removed by consumers from the dispenser 100, the product within the cartridge 200 continues to advance down the first channel 130 through openings 60 and 140, toward and ultimately into the second channel 150 where it is advanced to the front of the housing 110.

Figure 12A:
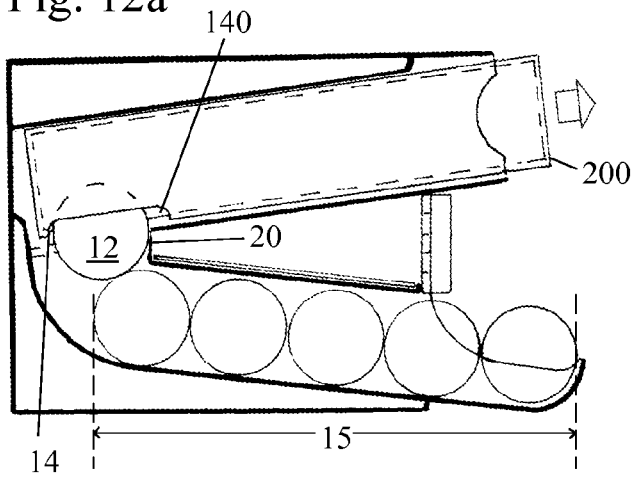
FIGS. 12*a* and 12*b* are a side cutaway view of the product dispenser, showing the dispenser with a cartridge having cans and an empty cartridge, respectively.
Figure 12B:
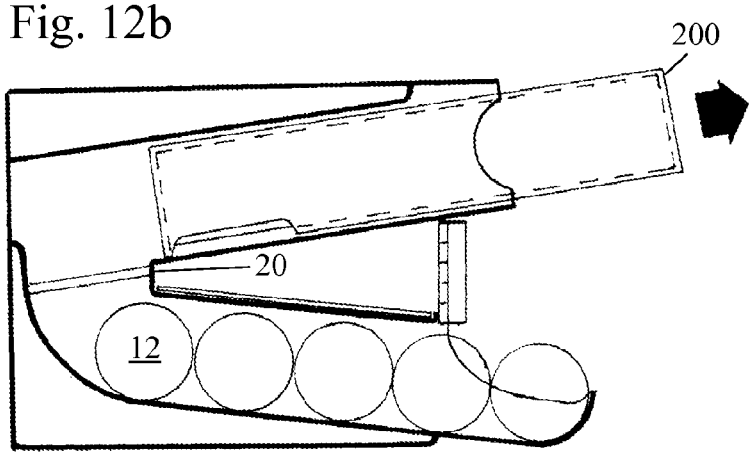

The length 15 (FIG. 12*a*) of channel 150 is chosen such that when the channel 150 is full and a cartridge 200 with product is in channel 130, one product 12 is located in opening 140, in line with blocking section 20. This provides a "self-locking" function, which allows a stock clerk, by pulling outwardly on the cartridge, to quickly and easily determine whether or not the cartridge is empty and in need of replacement. FIGS. 12*a* and 12*b* illustrate how this function works.

As discussed above and shown in FIG. 3, when there is at least one product remaining in the cartridge 200, one can 12 is located midway through opening 60 and opening 140, partially in and partially out of the cartridge. If a clerk pulls outward on the cartridge 200, as shown in FIG. 12*a*, the can 12 is trapped between blocking section 20 and the rearward lip 14 of opening 60. This prevents the cartridge 200 from being removed from channel 130, and tells the clerk that there is still product remaining in the cartridge. Upper, angular wall 132 serves to hold down the cartridge 200 top surface when installed into channel 130. This minimizes the movement of the cartridge 200 in the channel 130, so that the cartridge will not lift up and become removable before it is empty.

If the cartridge 200 is empty, however, as shown in FIG. 12*b*, there is nothing preventing the easy removal of the cartridge 200, and the clerk can then remove it and insert a full cartridge to restock the dispenser.

For this function to operate, the front end of the cartridge 200 and rearward lip 14—that is, the end of the cartridge adjacent to the opening 60—should remain sufficiently intact to provide the surface to contact the product while it is in contact with the blocking section 20.

It is desirable to refill store merchandising displays prior to them being empty to eliminate "out-of-stock" situations. As can be seen, when the cartridge unlocks from the dispenser of the invention, there will still be cans remaining in channel 150. The design thus may be refilled well prior to being empty, thereby eliminating "out-of-stock" situations, which are extremely negative for retail sales of products and general store appearance.

An end of the cartridge 200 is a closed end and remains forward facing and visible to the consumer when the cartridge 200 is loaded into the dispenser 100 and therefore, this end has a surface 219 that can contain indicia, such as advertising, and product information, promotional information, etc.

In conventional dispensing displays it is usual for such indicia to be field changeable at retail to facilitate plan-o-gram resets. This makes it possible, as is often seen at retail, for store personnel to mistakenly install indicia which do not match the products being dispensed therewith. This causes difficulty for both stocking personnel and shoppers with respect to proper stocking, pricing, locating and selecting of products. Indicia on surface 219 of the cartridges 200 of the present invention will be pre-printed or applied at the point of manufacture and will, therefore, be a dedicated identification of the specific products contained therein. This provides an error-free way to indicate to a consumer exactly which products are being dispensed from the display into which this cartridge 200 has been inserted.

It will be understood that the cartridge 200/dispenser 100 combination offers a number of advantages over conventional dispenser systems. For example, the loading of product is much less labor intensive since the product is not individually removed from the cartridge 200 and loaded into the dispenser but rather, the cartridge 200 is simply loaded into the first channel 130 where it remains until all of the product is transferred from the cartridge 200 to the second channel 150 at which time, the cartridge 200 is then removed and another full cartridge 200 is inserted into the dispenser 100.

The dispenser 100 is a self-standing structure that can be placed on a support surface, such as a shelf or other platform. It can also include a rear wall 114 mounting device or mechanism enabling the modules to hang from a fixture wall surface.

FIGS. 1 and 11illustrates a dispenser assembly which can be assembled from various combinations of a plurality of modular parts that are shown in FIG. 11, including a first panel 116, a second panel 114, a third panel 118, a transparent panel 152 and door panel 160 with indicia panel 42. The assembly of these parts forms the housing 110

The left and right panels 116, 118 are mirror images of one another. Each of the left panel and right panels includes a top rib that extends inwardly and in combination with the other top rib define the ceiling 132 and a middle rib that extends inwardly and in combination with the other middle rib defines the floor 134 of the first channel 130 when the panels 116, 114, 118 are mated together. Each of the left and right panels 116, 118 also includes a bottom wall or surface which in combination with each other or with a bottom wall or surface of the center panel 114 define the floor 154 of the second channel 150.

The second channel 150 can be equally divided into halves or thirds, etc., by one or more divider walls 40 of central panel 114. The various functions of this panel features are as follows. The divider wall 40 keeps individual product units separated as they feed forward through second channel 150 into individual facings for presentation to shoppers, adding to the organization and neatness of the display. Otherwise individual product units (cans) could become jammed in second channel 150 by interlocking with each other and the sidewalls 116, 118 during transit thereof. An upper edge 41 of the divider wall 40 where it transits opening 140 separates the lower portion of opening 140 into two, three or more individual openings sized to accept individual product units (e.g., cans) and leading into multiple second channels 150 and guides the dropping cans as they exit the cartridge 200 and fall through opening 140 into their respective second channels 150. The upper surface of central panel 114 where it underlays the transparent panel 152, is a Tee-shaped or similar supportive cross section which both supports and provides an attachment surface for assembly of transparent panel 152 within the housing by common means such as adhesives or the like. Central panel 114 also acts as a structural spacer between side walls 116 and 118, enabling the housing 110 to be assembled into varying widths for acceptance of various cartridge configurations and displaying various numbers of facings to shoppers. This multiple facing, modular capability allows brands and retailers to merchandise products on their shelves according to a plurality of varying matrices each having varying numbers of product facing counts and organizational plans, commonly referred to in the field as "plano-grams". It also enables the further reduction of packaging materials and handling in the supply chain by making it possible to use multiple facing cartridges which hold more products with less packaging material than if all cartridges were of the one facing design.

It will be appreciated that the modular design shown in FIG. 11 permits the design of housing 110 to be readily changed and customized according to need. For example, the components of FIG. 11 can be assembled to provide housings with 1, 2 or 3 facings of product units displayed to shoppers as shown in FIGS. 6*b*, 7*b* and 8*b*. For example, the dispenser shown in FIG. 6*b* is constructed by assembling the left and right panels 116, 118. The dispenser of FIG. 7*b* is constructed by assembling the left, one center and right panels 116, 114, and 118, and the dispenser of FIG. 8*b* is constructed by assembling the left and right panels 116, 118 with two center panels 114 to form a three facing dispenser.

The illustrated door 160 includes a shaped forward facing surface for labels 42 etc., which provides an exact "right side up" image of a product which can be presented to shoppers since the canned products may be on their sides in the dispenser. As mentioned above, the retailer stock clerk can easily view and count the inventory by simply opening the door 160.

The holes in the panels 116, 118 are for purpose of saving weight and material during manufacture (e.g., an injection molding process).

Figure 10A:
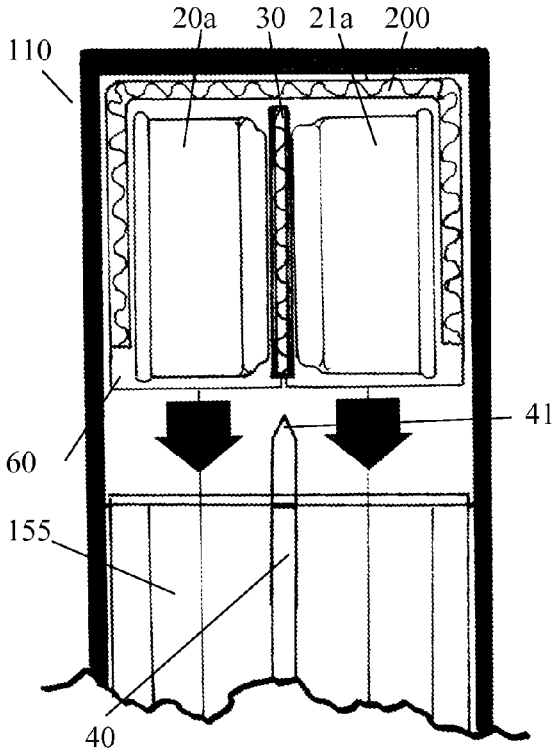
FIGS. 10*a* and 10*b* are cutaway views of the product dispenser, showing how cans are dispensed from the cartridge in a two-can wide embodiment.
Figure 10B:
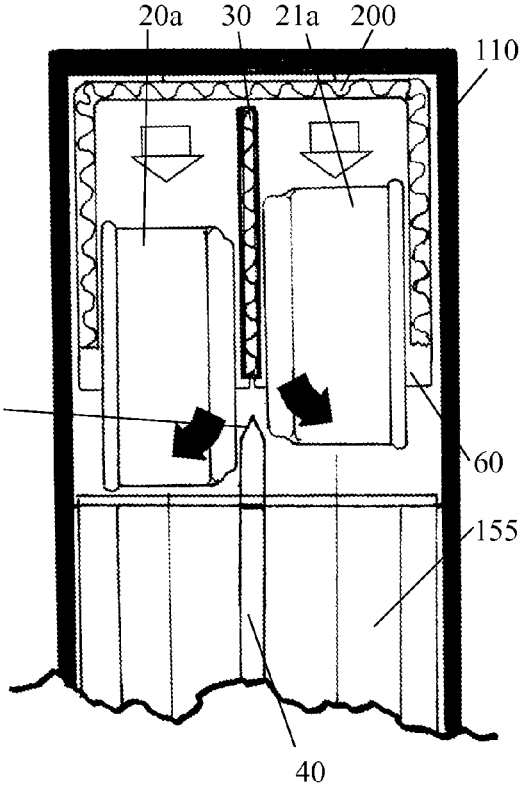

FIGS. 10*a* and 10*b* show a detail of the design, in embodiments with cartridges 200 in multiple can width (two-wide, in the figures). It can be seen in these figures that the corrugated paperboard "slip-sheet" 30 separating the rows of cans 20*a*, 20*b* inside the bulk pack cartridge 200 cooperates with a tapered edge 41 on the upper side of center panel 40. This guides falling cans separately onto arcuate section 155 and down into channel 150, minimizing twisting and jamming of cans.

Second Embodiment—Overhead Pusher for Shelves

Now referring to FIGS. 13*a-f* to 20, a dispenser 300 according to a second embodiment is illustrated. In this embodiment, the dispenser 300 can be formed of an upright frame 310 that includes a number of support surfaces 320, such as horizontal shelves. For example, the support surface 320 can be a planar platform that includes a top surface 322 and an opposing bottom surface 324. The platform 320 is constructed so that a biased product feed mechanism 330 is disposed therein and is configured to controllably advance the product as it is removed by consumers.

More specifically, the feed mechanism 330 includes a bias member 340 that is associated with the platform 320 and is coupled to a pusher plate 350. For example, the biased feed mechanism can be in the form of a spring assisted pusher plate module that includes the pusher plate 350. The bottom surface 324 is tracked, slotted or channeled 325 to accept installation of the spring assisted pusher plate module. For example, the tracks can be in the form of slots and ribs; can be "I" shaped or "H" shaped; or can be "T" shaped or "L" shaped; or any similar cross-section that creates a channeling matrix. The bias member 340 can be in the form of a coil spring (variously referred to as coiled, flat, band or negator constant force spring) that has a one end 342 fixedly attached to the platform 320 and another end is coupled to the pusher plate 350 such that in a rest position, the biasing force of the spring applies a force to the pusher plate 350 and drives the pusher plate 350 to a front edge 321 of the platform 320.

The conventional use of spring loaded push members, such as at cosmetic counters, once again involves removing the product from packaging and then loading the product into individual feed rows, with each feed row having a spring loaded push member extending either upward from the floor thereof or outwardly from the sidewalls thereof. However, in the present invention, the feed mechanism 330 is inverted and included in the ceiling as opposed to the floor of the display. Thus, the pusher plate 350 extends downwardly from the bottom surface 324 toward the top surface of the underlying platform 320 and is designed to engage product as described below.

Figure 14:
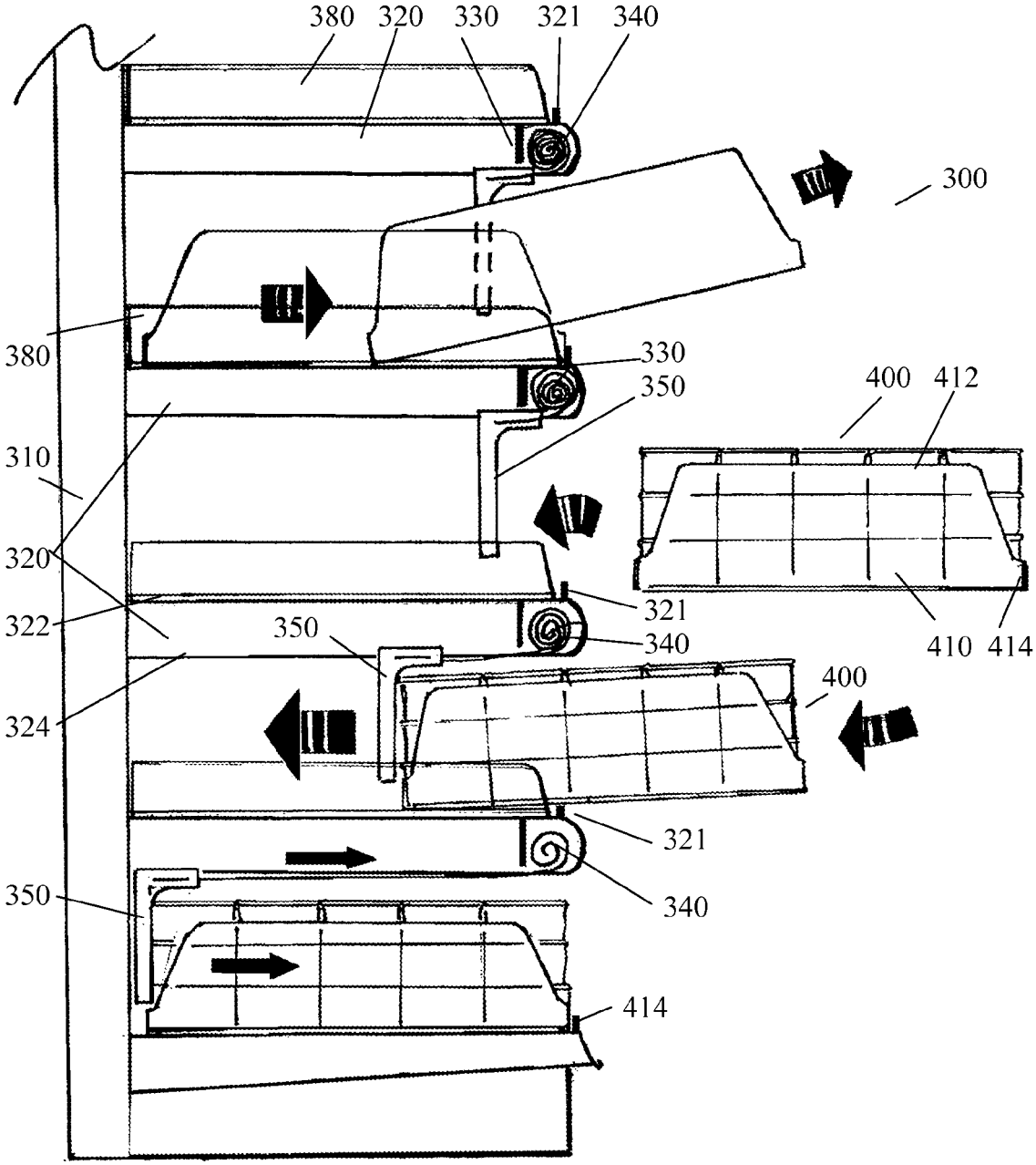
FIG. 14 shows a second embodiment of the invention utilizing shelf-mounted pushers.

As shown in FIG. 14, when a product filled cartridge 400 is loaded onto the platform 320, the filled cartridge 400 drives the pusher plate 350 rearward toward a rear of the dispenser 300. This results because the stock person applies a rearward force to the filled cartridge which transmits the force to the pusher plate 350 that overcomes the natural biasing force of the spring and thus, the pusher plate 350 is driven rearward. As the pusher plate 350 is driven rearward, the spring unwinds and stores energy. The pusher plate 350 moves within the track 324, 325 so that it can be moved in a smooth, controlled manner.

Each platform 320 can include a number of adjustable dividers 380. In particular, the top surface of the platform 320 receives a plurality of position adjustable row dividers 380 to organize tray cartridges 400. These dividers 380 are inserted into guide channel(s) which permit transverse (side-to-side) movement and positioning of the dividers 380 along the top surface of the platform 320. This permits different sized (e.g., different widths) cartridges 400 to be used in the dispenser 300. The dividers 380 can divide one product from another product.

In one embodiment, the guide channel is in the form of the stop wall 321 that is located along the front edge of the platform 320 and also serves to stop and limit forward movement of the cartridge 400 when the pusher plate 350 applies a force to the product contained therein. Other similar guide channels or row divider locating devices/mechanisms are possible.

In the illustrated embodiment, the cartridge tray 400 includes a body 410 that includes opposing side walls 412 and opposing end walls 414 that extend between the side walls 412. As seen, the side walls 412 have a height that is much greater than a height of the ends 414 since the product is removed by the consumer through one end 414. The higher side walls 412 permit the product to be stacked within the cartridge body 410 and hold the products securely during transport. The number of layers and the number of rows of product within the cartridge body 410 will vary depending upon the particular product and packaging and display specifications. For example, the illustrated embodiment has three layers of cans 50 stacked on top of one another. The front end wall 414, facing shoppers, is just high enough that the bottom row is prevented from moving; however, the top portions of the bottom rows of cans are located above the top edge of the front end wall 414, thereby permitting the cans to be easily removed. However, the height of the stop wall 321 is great enough that the cartridge 400 will not simply jump the stop wall 390 when the biasing force is applied. The end wall 414 abuts against the stop wall 390.

As shown in FIG. 14, an empty cartridge 400 can be simply lifted over the stop wall 321 and removed since the rear end wall 414 of cartridge 400 is just low enough to slide underneath the bottom edge of the pusher plate 350 to permit removal of the cartridge 400. Conversely, to load a full cartridge, the cartridge 400 is angled and inserted above the stop wall 321, and the pusher plate 350 locates behind the rearmost stack of product. Both front and rear end walls 414 are sized to satisfy the following specifications: high enough to prevent product units from inadvertently jumping the end wall; low enough to conveniently expose the tops of the bottom rows of products for shoppers; and low enough to clear the bottom edge of the pusher plate such that the biasing force applied by the pusher plate acts only upon all stacks, rows and columns of products, but not upon the cartridge tray. More specifically, the design and sizing of the end walls 414 of the tray cartridges effectively provide a "notch" allowing clearance for the pusher plate through the sidewalls of the cartridge and providing forcible contract between it and the product stacks. As mentioned above, the bottom of the pusher plate 350 reaches the top portion of the bottom stack of the product and the bottom edge of the pusher plate 350 is disposed just over the end wall 414. Since the pusher plate 350 is initially closer to the stop wall 321, the insertion of the filed cartridge 400 causes the pusher plate 350 to be driven rearward under the applied force of the filled cartridge 400. In the fully inserted position of the cartridge 400, the pusher plate 350 clears the top of the cartridge rear end wall 414 and applies a forward force to the product and as product is removed from the front of the cartridge 400 and in particular, when one column of product is removed, the spring biasing force of the feed mechanism causes the columns and rows of the product to advance forward. As more and more columns and rows of product are removed, the remaining product is continually advanced forward toward the stop wall 321. While the product feeds forward, the cartridge tray (body) 410 remains stationary.

It will be appreciated that, since the product units are being advanced forward by the biasing force of the spring loaded pusher plate rather than rolling or by other gravitational force, the product displayed and dispensed in this embodiment is not limited to being cans which roll but can also be in the form of variously shaped packages.

Currently such trays are displayed mainly in two ways:

First; they are unwrapped from their shrink film and placed as is on a shelf or other supporting display structure of some sort.

Second; the products are individually removed from the tray and placed individually on a shelf or other supporting display structure In both instances, no provision is made, nor can one be made without additional device(s) for the automatic front facing (or forwardly feeding) of the products toward shoppers for easy selection and removal of products while shopping.

While there are existing a wide variety of such tray designs the design of the present merchandising display invention addresses all of those and only those which have low front and rear walls, as illustrated herein, such that products protrude upwardly accessible thereabove. Assuming same, the shrink film is removed as always and the tray is installed upon the supporting shelf of the present invention as always, except that it must be behind the low front stop wall of the shelf after installation. (This "stop wall" may also be taller if it is manufactured from a clear material, so as not to obstruct a shopper's view of the products in the tray. In either design, this wall should not be sufficiently tall to obstruct easy selection and removal of products by shoppers)

Figure 17:
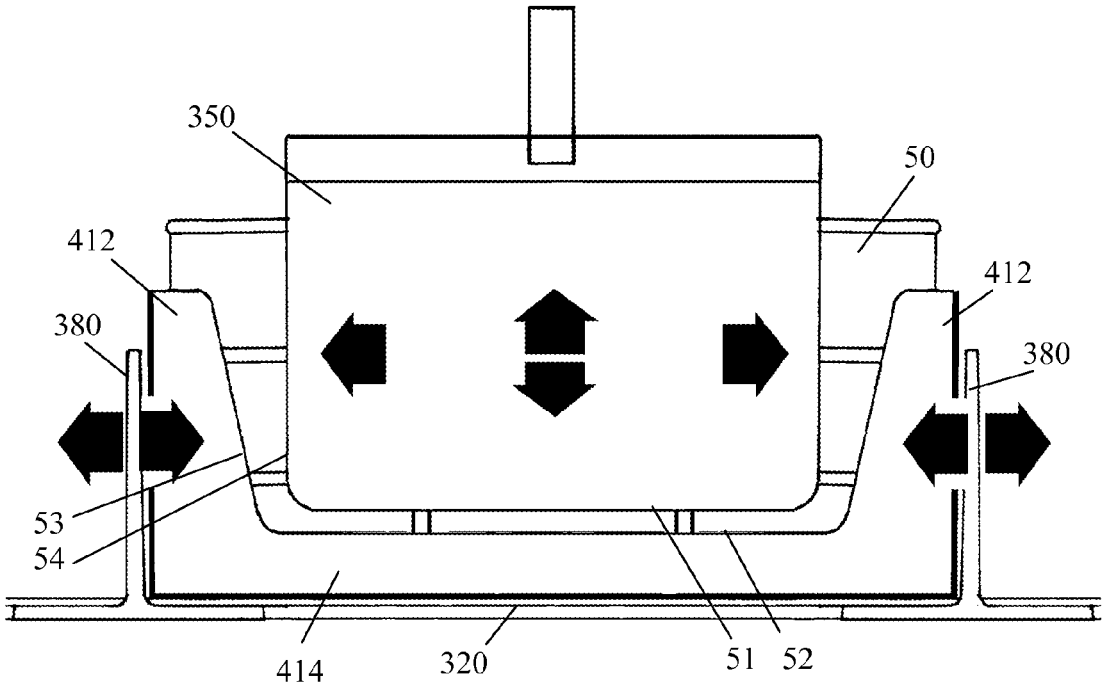
FIG. 17 shows a rear view of the second embodiment of the invention
Figure 18:
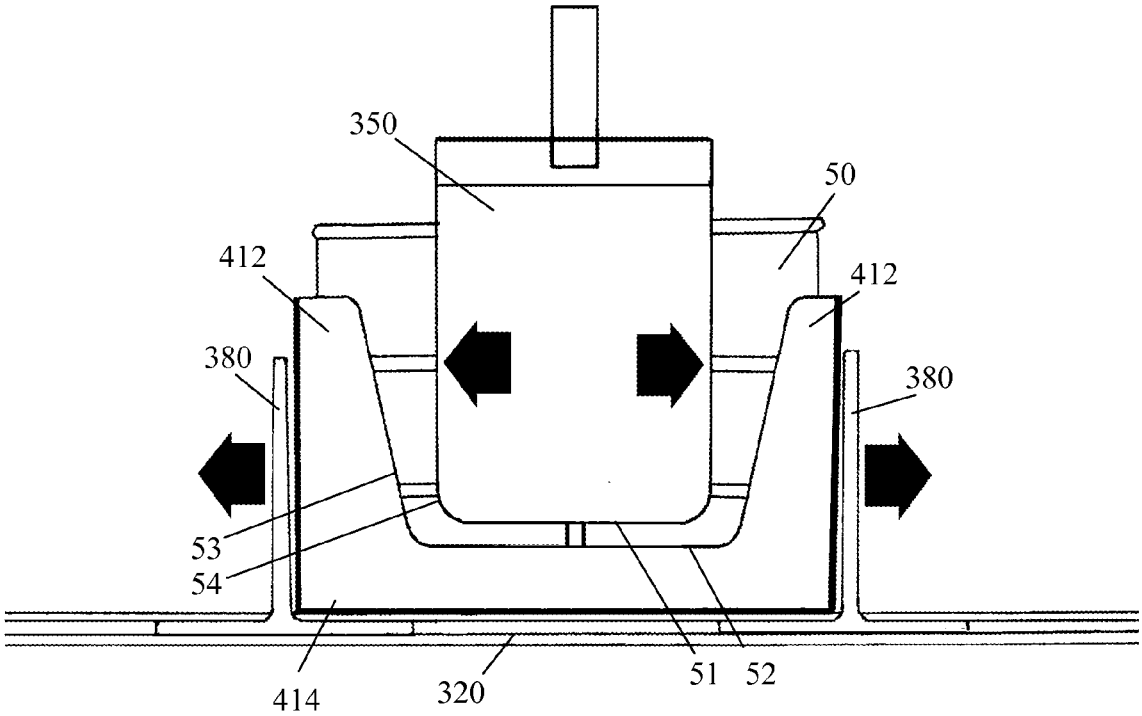
FIG. 18 shows another rear view of the second embodiment of the invention.

As shown in FIGS. 17 and 18, left-to-right slidably adjustable row dividers 380 mounted within some type of channeling system and affixed to the top surface of said supporting shelf (structure) 320 and left-to-right slidably adjustable pusher modules 350 mounted within some type of channeling system and affixed hanging downwardly from the underside of said support shelf (structure) having been positioned to capture and position the tray and centered behind the products in the trays (respectively); the products will now be pushed forwardly within the trays towards a shopper.

The vertical spacing of the shelves and the vertical height and spacing of the pusher plates and pusher modules must be such that the bottommost edges of the pusher 51 plates, after assembly and installation of the trays will clear the topmost edge 52 of the lip of the tray rear wall 414 and push directly against only the product packages 50. Similarly, the side edges 54 of the pushers 350 need to clear the side edges 53 of the tray rear wall 414.

Figure 15:
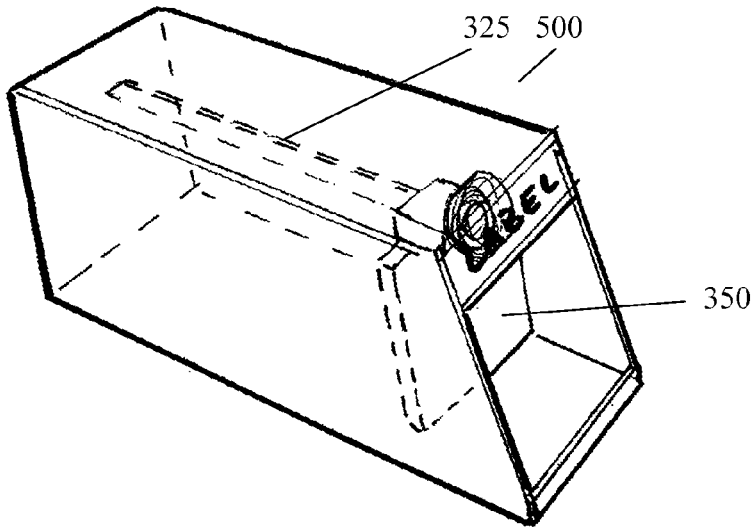
FIG. 15 shows details of the second embodiment of the invention.
Figure 16:
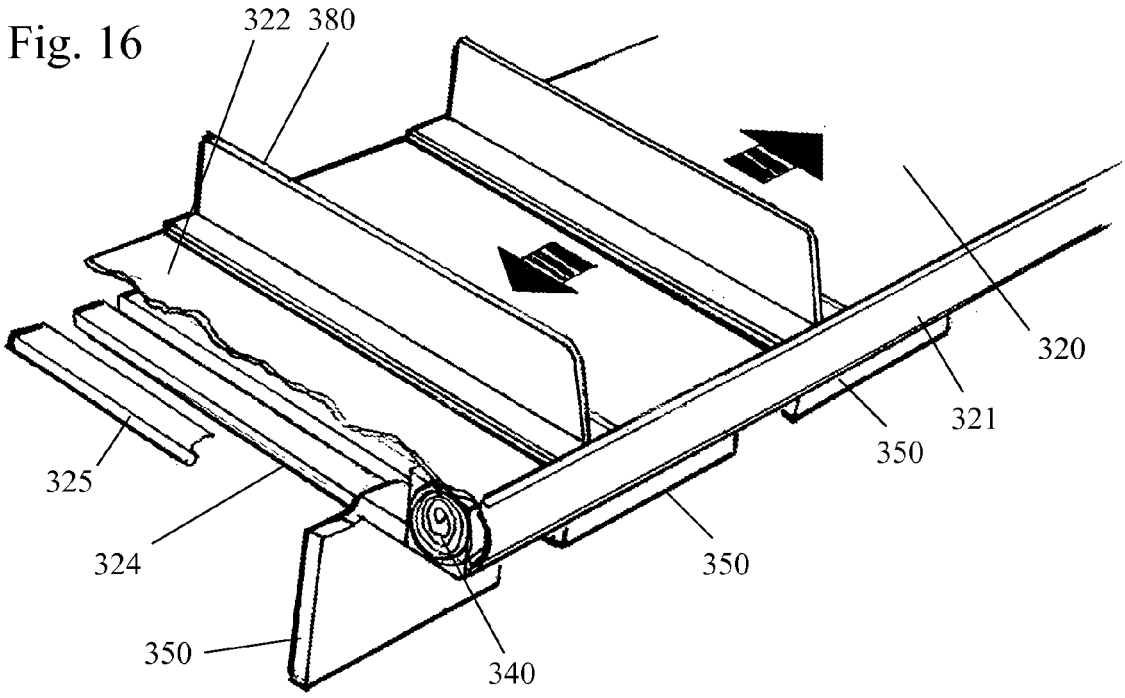
FIG. 16 shows details of the second embodiment of the invention.

FIG. 15 is a perspective view of a single enclosed housing 500 with a single feed mechanism. A single spring-biased pusher plate 350 is disposed within the housing 500 and advances the product forward. As with the above embodiment, the pusher plate 350 is disposed upside down compared to normal usage. The housing 500 includes a surface 502 for indicia, such as advertising, product information, promotional information, etc. This embodiment also works well with enclosing tubes instead of two-sided platforms available in a plurality of widths/heights. The tubes can sit on plain platforms or contain a mounting detail for wall hanging.

As with the other embodiments, the cartridge 400 is intended to remain in place within the dispenser during use.

Figure 19:
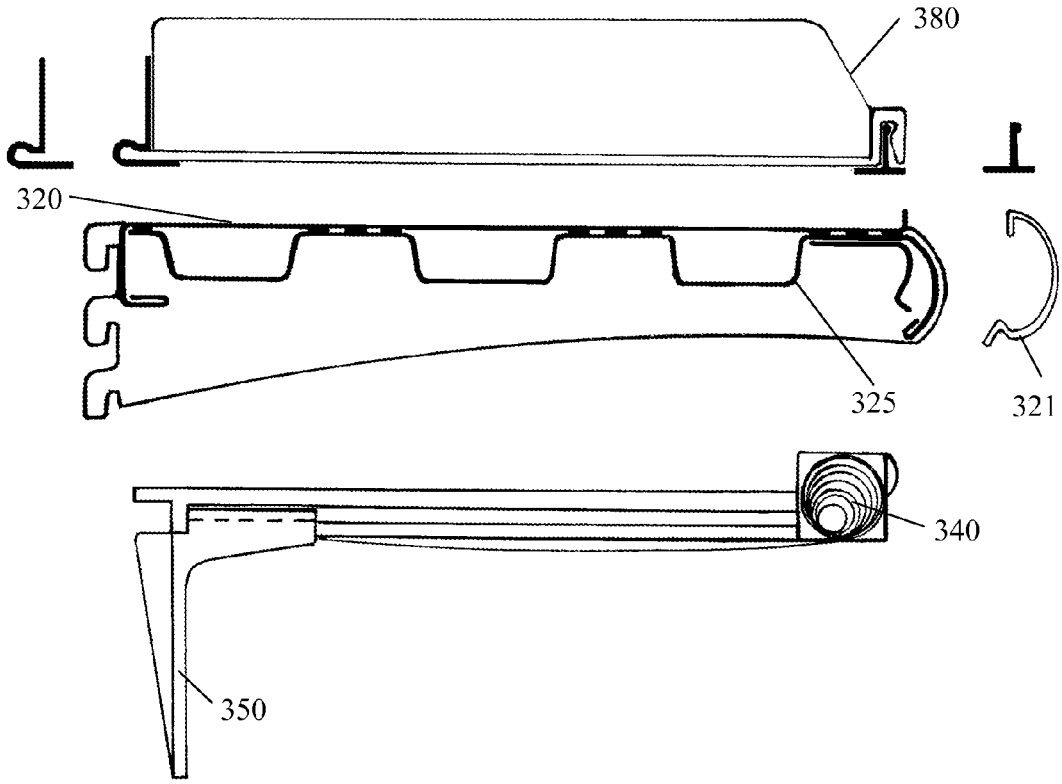
FIG. 19 shows an exploded side view of the second embodiment of the invention.
Figure 20:
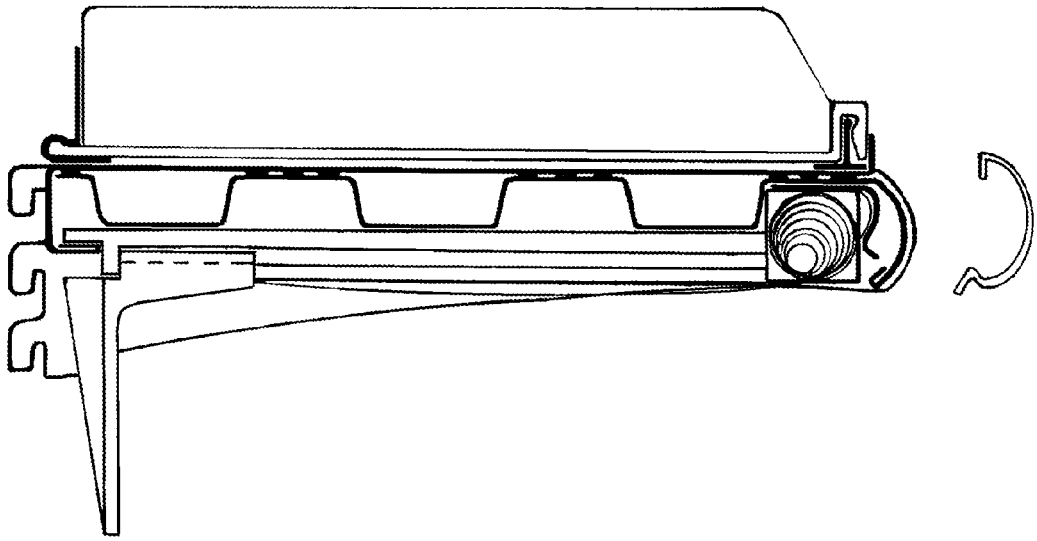
FIG. 20 shows an assembled side view of the second embodiment of the invention.

FIG. 19 shows an exploded diagram of a side-view of the second embodiment, and FIG. 20 shows the same view with the invention assembled.

Figure 13A:
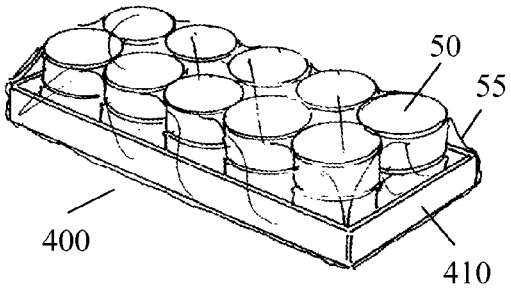
Fig. 13a Prior Art
FIGS. 13*a*-13*f* show various types of prior art product shipping packages in the form of shrink-wrapped trays.
Figure 13B:
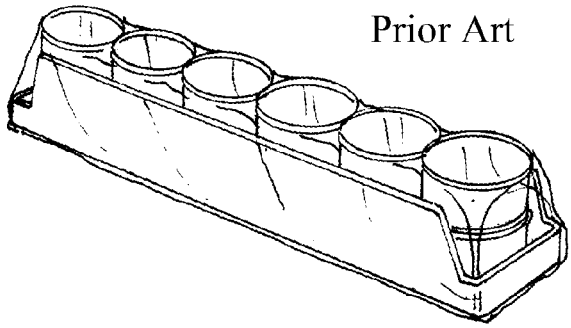
Fig. 13b Prior Art
Figure 13C:
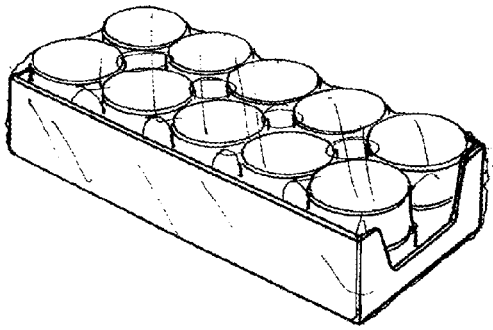
Fig. 13c Prior Art
Figure 13D:
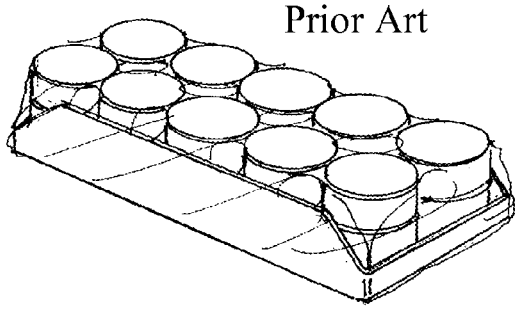
Fig. 13d Prior Art
Figure 13E:
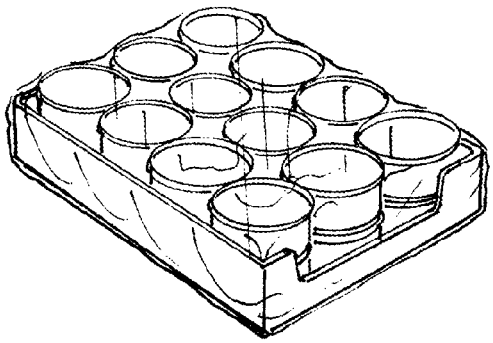
Fig. 13e Prior Art
Figure 13F:
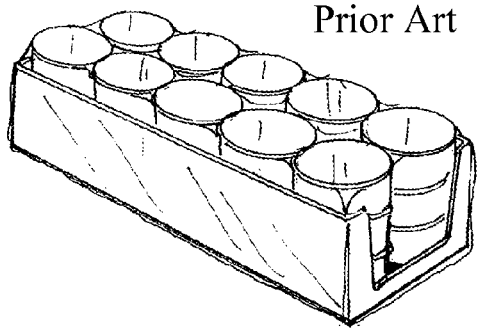
Fig. 13f Prior Art

FIGS. 13*a*-13*f* illustrate cartridge packs include products arranged in an organized and manageable variety of configurations. Each of these packs includes stacked product 50 that is arranged in rows and columns and each pack has a front edge that permits the product to be removed from the pack but at the same time restrains forward movement of the cartridge. Cartridge shipper packs in this embodiment are open top and can be formed as chipboard trays with a shrink film enclosure 55. FIGS. 13*a*-13*e* show that the cartridge pack can be an open tray enclosed for shipping with a shrink film. This arrangement is equally applicable to cans stacked two-high (FIGS. 13*a*-13*e*) or three high (FIGS. 13*f*). Cans can be in one row (FIG. 13*b*), two rows (FIGS. 13*a*, 13*c*, 13*d* or 13*f*) or three rows (FIG. 13*e*), or even more.

This design will also work with non cylindrical or rectilinear packaging, as the spring pusher is providing the forwardly feeding force rather than the rolling of cylinders.

The system will also work with a second embodiment wherein the trays are inserted into and enclosed within individually, size-dedicated tubular channels with pre-installed spring pushers, as shown herewith. Such a system can be simply and easily installed upon the top surface of any existing store gondola shelving It will be appreciated that all of the cartridges disclosed herein can be manufactured from 100% recycled/recyclable stock and/or cellulosic based resins (non-petroleum).

The following additional features are realized in the dispensers and cartridges according to the present invention: (1) orientation during packing of individual product packages inside the SKU cartons according to how they will feed and be automatically front faced for viewing by shoppers; (2) tearable, perforated panels in cartridge cartons which, when removed, create openings through which individual product packages feed forwardly within and in a manner according to the dispensers of the present invention; (3) appropriately located printed or labeled panels on the cartridges, which when displayed at retail in the display(s) of this system, inform shoppers in a dedicated way, each cartridge to its specific dispenser, of product identity and other information required to locate specific product types and make an informed selection/purchase decision; and (4) across entire brands, types and/or categories of products (all canned pet food for example) a matrix plurality of cartridge carton accepting display devices which automatically feed & front face product packages for viewing by shoppers, are stocked and restocked with product inventory in the store aisles by the insertion of an entire bulk cartridge without handling of individual product packages.

The main improvement and benefit of these designs, in either embodiment, is that an entire bulk shipper carton or tray, pre-packed with products from the point of manufacture and/or distribution can be loaded by a stocker in a single motion onto either an existing store shelf, or a custom designed shelf, both of which then have an integral means of both attractively displaying and presenting the products for purchase by automatically front facing or forwardly feeding the individual product packages toward the shoppers, while the bulk shipper tray/carton remains within the display housing. This will simultaneously improve the shopping experience for shoppers and greatly reduce stocking time for retailers, a combination which does not currently exist.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A product dispenser assembly, comprising:

a) a cartridge holding a plurality of cylindrical products, having a front end and a rear end with a length therebetween sufficient to accommodate a plurality of products, a height between a top and a bottom sufficient to accommodate one cylindrical product while allowing the product to roll within the cartridge, and a width between a first side and a second side sufficient to accommodate at least one cylindrical product while allowing the product to roll within the cartridge, and an openable section in the bottom adjacent the front end of the cartridge, sufficiently large to allow a product to drop out of the cartridge through the openable section;

b) a dispenser housing having a front and a rear, comprising:

i) a first channel sized for receiving the cartridge, sloping downward from a front opening at the front of the housing toward a rear opening at the rear of the housing, the rear opening being sized and located such that when a cartridge is fully inserted in the first channel with the front end of the cartridge adjacent to the rear of the housing, the openable section in the cartridge aligns with the opening in the first channel and a product can pass freely from the openable section of the cartridge through the rear opening of the first channel;

ii) a sloped portion located underneath the rear opening of the first channel, having an open top, a vertical blocking section located on a front side, and a sloping ramp on a rear side for guiding product passing from the cartridge through the rear opening; and iii) a second channel sized for receiving at least one product, having a rear end adjoining the sloped portion and an open front end having a stop, the channel sloping downward along a length from the rear end to the front end;

such that when a cartridge containing products is inserted in the first channel, product exits the cartridge through the openable section of the cartridge and the rear opening of the first channel, drops and rolls through the sloped portion into the second channel and rolls down the second channel to rest against the stop, for removal through the open front end of the second channel; and wherein the length of the second channel is chosen such that when the second channel is full of cylindrical products and a cartridge containing products is in the first channel, one product is located in the rear opening of the first channel, in line with the blocking section, such that removal of the cartridge from the first channel is blocked by contact of the one product with the blocking section and the rear of the cartridge.

2. The product dispenser of claim 1, in which a length of the first channel is no longer than than the length of the cartridge, such that when a cartridge is fully inserted in the first channel at least a part of the cartridge extends out of the first channel.

3. The product dispenser of claim 1, in which the first channel further comprises a plurality of arcuate finger cutouts at the front opening of the first channel, to facilitate gripping a cartridge inserted in the first channel.

4. The product dispenser of claim 1, in which the width of the cartridge accommodates a plurality of rows of cylindrical products, and the cartridge further comprises a separator partition between each of the rows of products.

5. The product dispenser of claim 4, in which at least the sloped portion and the second channel further comprise at least one divider wall, aligned with the at least one separator partition of the cartridge, dividing the sloped portion and the second channel into a plurality of lines for the plurality of rows of products.

6. The product dispenser of claim 5, in which an upper edge of the divider wall in the sloped portion is tapered to guide the rows of product into the lines in the second channel.

7. The product dispenser of claim 1, in which the housing further comprises a door located between the front opening of the first channel and the front end of the second channel.

8. The product dispenser of claim 1, in which the second channel further comprises a transparent ceiling, such that a quantity of product in the second channel may be ascertained by looking through the transparent ceiling.

9. The product dispenser of claim 1, in which the rear end of the cartridge is closed, and the cartridge further comprises indicia printed on the closed rear end of the cartridge.

10. The product dispenser of claim 9, in which the indicia comprises a product information label.

11. The product dispenser of claim 1, in which the first channel further comprises a first ceiling for holding the cartridge down in alignment with a floor of the first channel.

12. The product dispenser of claim 1, in which the sloping ramp of the sloped portion has an arcuate shape.

13. The product dispenser of claim 1, in which the slope of the first channel is approximately 7 degrees.

14. The product dispenser of claim 1, in which the slope of the second channel is approximately 7 degrees.

15. The product dispenser of claim 1, in which the openable portion of the cartridge is formed by perforation of the cartridge such that material in the openable portion may be removed by separating the cartridge along the perforations.

* * * * *